US005385040A

United States Patent [19]

Michael et al.

[11] Patent Number: 5,385,040

[45] Date of Patent: Jan. 31, 1995

[54] PRESS COMPRISING A TRANSFER DEVICE FOR SHEET METAL PARTS

[75] Inventors: Wolfgang Michael, Göppingen; Karl Thudium, Wäschenbeuren; Hans Hofele; Walter Rieger, both of Göppingen; Peter Klemm, Stuttgart; Burkhardt Schumann, Ottenbach, all of Germany

[73] Assignee: L. Schuler GmbH, Germany

[21] Appl. No.: 147,289

[22] Filed: Nov. 5, 1993

[30] Foreign Application Priority Data

Nov. 5, 1992 [DE] Germany ..... 4237315

[51] Int. Cl.[6] ..... B21D 43/05

[52] U.S. Cl. ..... 72/405

[58] Field of Search ..... 72/405, 422, 421

[56] References Cited

U.S. PATENT DOCUMENTS

| | | | |
|---|---|---|---|
| 3,179,262 | 4/1965 | Carlson | 72/405 |
| 3,342,125 | 9/1967 | Curran | 72/405 |
| 4,589,819 | 5/1986 | Shirao | 72/405 |

FOREIGN PATENT DOCUMENTS

| | | | |
|---|---|---|---|
| 2038681 | 7/1980 | United Kingdom | 72/422 |
| 2243134 | 10/1991 | United Kingdom . | |

*Primary Examiner*—Daniel C. Crane

*Attorney, Agent, or Firm*—Evenson, McKeown, Edwards & Lenahan

[57] ABSTRACT

A transfer device in a press line has traverses which are situated transversely with respect to the workpiece passage and can be adjusted in the horizontal and vertical direction, and which support sheet metal parts placed on them. The traverses are fastened on toothed belts are movable in guide strips on deflecting rollers by servomotors.

14 Claims, 5 Drawing Sheets

11
(11)
16
9
2
22
III
13
21
7
17
16
8
3
17
14
III
3
6
12
19
18
15
16
5
4
14
1
(7)

PRESS COMPRISING A TRANSFER DEVICE FOR SHEET METAL PARTS

BACKGROUND AND SUMMARY OF THE INVENTION

The present invention relates to a press, an individual press, a multistage press, a multistand press, a transfer press or similar forming facility, with one press slide or, if necessary, several press slides which, for the forming of sheet metal parts can be moved up and down while interacting with tools. The forming facility also has a transfer device with holding devices which hold and transfer the sheet metal parts, driving devices for the lifting and lowering of the holding devices, and driving devices for moving the holding devices in a passage direction.

The transport of the sheet metal parts through presses of the above-described type takes place by means of a transfer device with a two- or three-dimensional movement of the holding devices for the sheet metal parts.

In German Patent Document DE 33 29 900 A1, a transfer device in a transfer press is described which has two transfer bars which can be moved in three axes (three-dimensionally) and which extend horizontally and at a parallel distance from one another. In addition, the transfer device has an advancing mechanism arranged on one end of the transfer bar for generating a reciprocating movement, as well as two clamping mechanisms for the clamping and releasing movement, and two stroke mechanisms for the lifting and lowering of the transfer bars.

The advancing, clamping and stroke mechanisms are each driven by a separate d.c. servomotor which are assigned to one transfer bar side; and the longitudinal, transverse and vertical strokes of the transfer bars can be varied continuously and independently of one another. The driving movements are transmitted to the drive side of the second transfer bar by means of a torsion bar.

U.S. Pat. No. 4,625,540 describes a transfer device in a transfer press of the two-dimensional type, in which running rails in the longitudinal dimension of the press can be lifted and lowered while being situated in front of and behind the tools. In the running rails, a frame is disposed which can be moved horizontally in the dimension of the press. Bars which extend in their length transversely with respect to the dimension of the press and have holding devices for the sheet metal parts are arranged on the frame. In addition to the movement of the frame, the bars can be moved in a movement along the dimension of the press. The drive of the lifting and lowering movement of the running rails and thus of the frame and the drive of the frame in the horizontal plane and of the additional movement of the bars takes place in a cam-controlled manner and thus in a restricted manner as a function of the press.

An object of the present invention is to bridge the distances from one press stage to the next or from one press to the next, for example, in the case of a press line. The transfer movements of lifting/lowering and transferring/return of the transfer device needs to take place independently of the transfer movements of the transfer device in the individual press and in separate axes.

This and other objects are achieved by the present invention which provides a forming facility comprising at least one press slide for the forming of sheet metal parts in machining stages and is movable up and down while interacting with tools, a first transfer device with holding devices which hold and transfer the sheet metal parts, the first transfer device having first driving devices for the lifting and lowering of the holding devices and second driving devices for moving the holding devices in a passage direction through one of the machining stages, and a second transfer device with holding devices for a sheet metal part. The holding devices of the second transfer device are liftable and lowerable and movable horizontally in and against the passage direction, the second transfer device being connected at least one of in front of and behind the first transfer device. The second transfer device at least one of inserts the sheet metal parts and removes the sheet metal parts in and out of one of the machining stages for conveyance of the sheet metal parts in the passage direction.

The above stated objects are also achieved by an embodiment of the present invention which provides a forming facility comprising a plurality of presses combined in a press line, with at least one slide for each press which can be moved up and down for the forming of sheet metal parts while interacting with tools. At least one transfer device with holding devices holding and transferring the sheet metal parts is provided, comprising driving devices for the lifting and lowering of the holding devices and driving devices for moving the holding devices horizontally in a passage direction. Each of the presses has a first one of the transfer devices respectively which removes the sheet metal part from an insertion stage or a machining stage and conveys the sheet metal part in the passage direction, and a second one of the transfer devices connected between the first transfer device of one press and the first transfer device of the press which follows in the press line.

In addition to the advantages which result from the capability of existing presses and press lines to be retrofitted, it is also advantageous to operate the individual presses of a press line independently of one another, not synchronously and to adapt the supplying of sheet metal parts to the press that follows. Other advantages result from the reduction of the mass of the transfer device to be moved in contrast to known devices, and the versatile use as an intermediate depositing device, an insertion device or as a removal device.

Other objects, advantages and novel features of the present invention will become apparent from the following detailed description of the invention when considered in conjunction with the accompanying drawings.

DETAILED DESCRIPTION OF THE DRAWINGS

Figure 1:
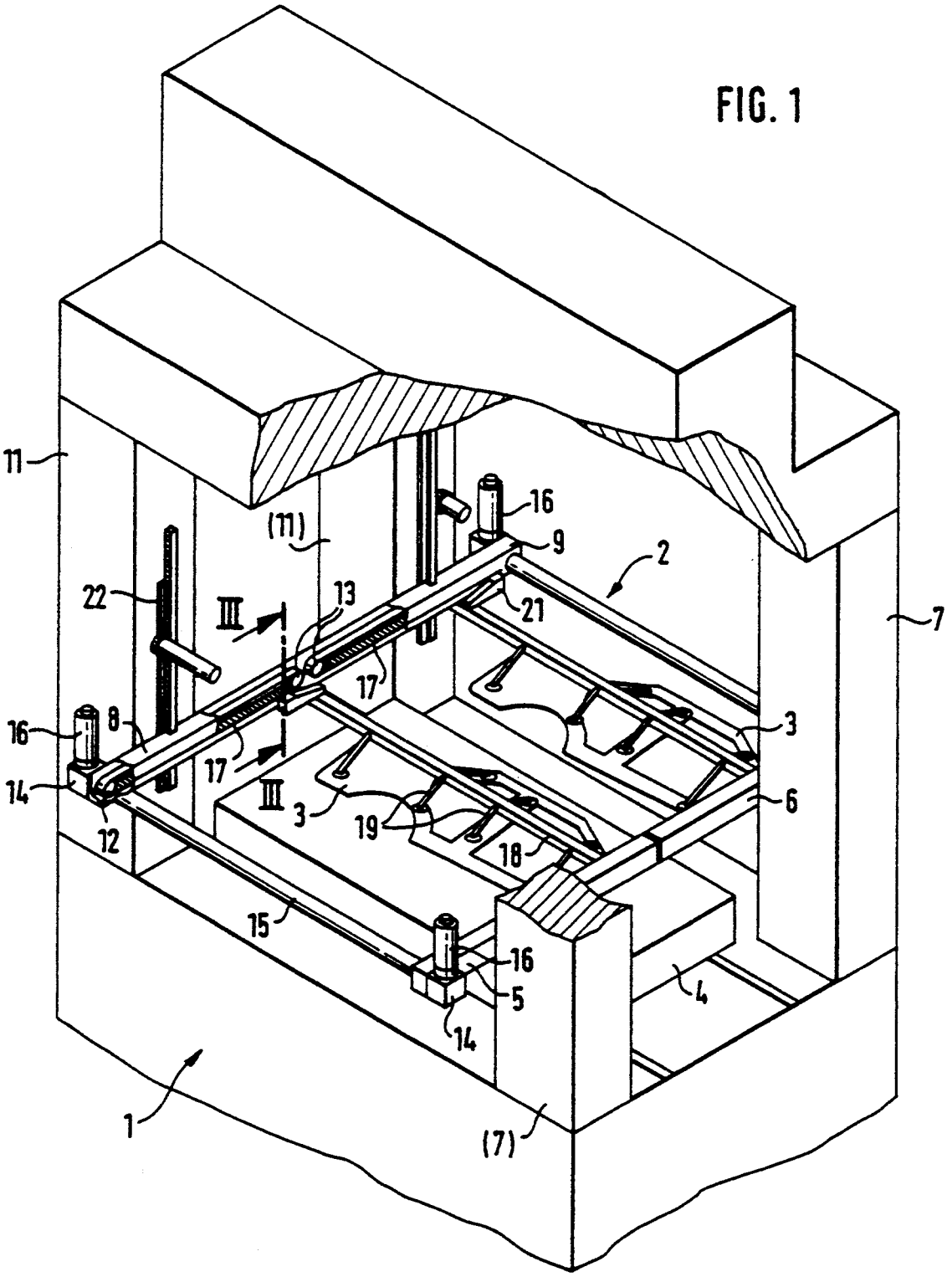
FIG. 1 a view of an individual press with a transfer device for the inserting and with a transfer device for the removal into and out of the machining stage constructed in accordance with an embodiment of the present invention.
Figure 2:
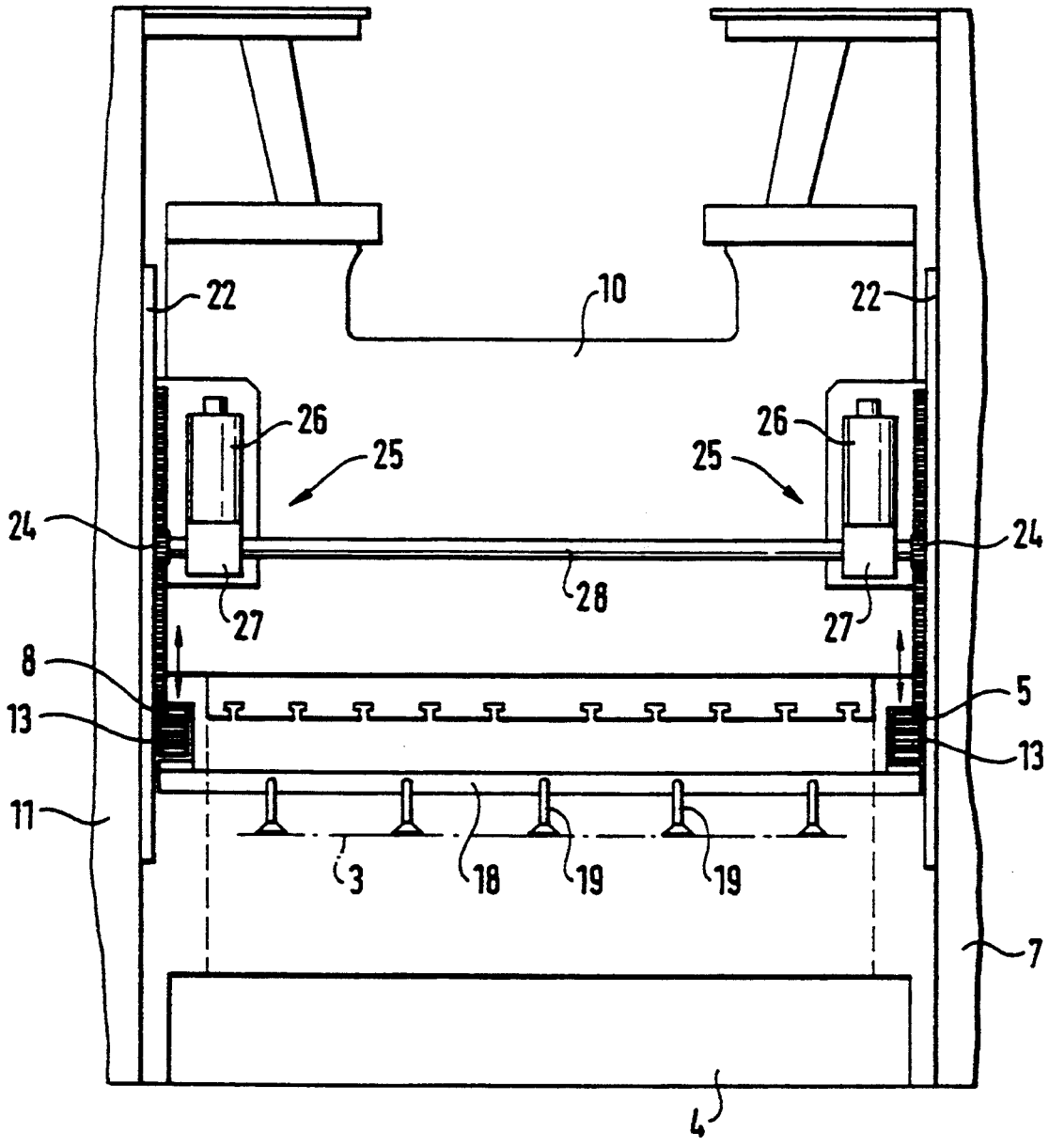
FIG. 2 is a view of the individual press according to FIG. 1 in a passage direction of the sheet metal parts.

The individual press in FIG. 1 and FIG. 2 shows an insertion device (insertion feeder) 1 and a removal device (removal feeder) 1 for the inserting of sheet metal parts 3 into the machining stage and for the removal of sheet metal parts 3 from the machining stage of the press. The machining stage is formed by a tool or a tool set (not shown). These tools can be exchanged via the movable sliding table 4, the top part of the tool being fastened to the press slide 10. Each of the transfer devices, the insertion device 1 and the removal device 2, have a first guide strip 5 and 6, which are assigned to the forward press stands 7, and a guide strip 8 and 9 which are assigned to the rearward press stands 11. Each of the guide strips 5, 6, 8, 9 is equipped with deflecting rollers 12, 13. The deflecting roller 12, in each case, is rotationally drivable via a transmission 14 and a servomotor 16.

A toothed belt 17 is placed around the deflecting rollers 12, 13 in order to horizontally move a suction bar 18 with suction devices 19. In the same manner, the suction bar 18 may be a magnet-equipped traverse or the like for the holding and moving of the sheet metal parts 3. The suction bar or the traverse 18 is fastened by driving devices 21 on the end face to one toothed belt 17 respectively in the forward guide strip 5 or 6 and in the rearward guide strip 8 or 9. The transmission 14 and the deflecting rollers 12 are connected by a torsion bar 15 in order to still be able to complete the transport in the case of, for example, a breakdown of one drive side.

Figure 3:
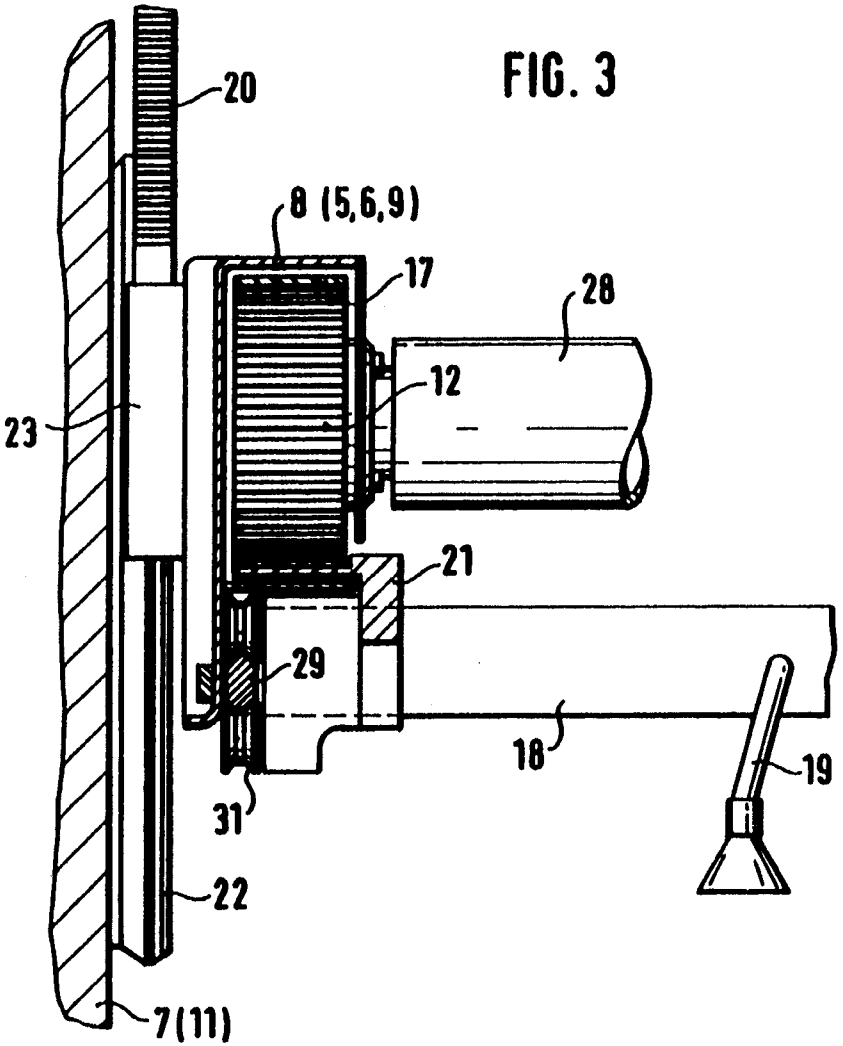
FIG. 3 is a sectional representation corresponding to the section III—III in FIG. 1.

As illustrated in FIG. 3, each of the guide strips 5, 6, 8, 9 is disposed in at least one vertical guide 22 so that its height can be adjusted. As shown in FIGS. 2 and 3, the vertical guide 22 may be arranged on the press stands 7 or 11 or on the frame of a ground device, as will be described in the following. For this purpose, each guide strip 5, 6, 8, 9 is fastened to a guide carriage 23. The guide carriage 23 has a vertically aligned toothed rack 20 into which a gearwheel 24 engages of a lifting/-lowering drive 25 which is fixed to the frame. The lifting/lowering drive 25 is fastened on the press frame or on the frame of the ground device and has one or two servomotors 26 which act via a transmission 27 on the gearwheel 24. The two transmissions 27 of the lifting/-lowering drive 25 or the gearwheels 24 are connected with one another by a torsion bar 28 in order to still be able to complete the lifting/lowering movement if one of the drives should fail.

FIG. 3 also illustrates a guide rail 29 which is fastened to the guide strip 5, 6 and on which the suction bar or the traverse 18 is disposed via rollers 31 in a horizontally movable manner. The toothed belt 17 is placed around the deflecting roller 12 and the suction bar 18 is fastened to the toothed belt 17 by the driving devices 21. The actuating of the servomotors 16, or a single servomotor 16, drives the suction bar 18 via the toothed belts 17 in the horizontal direction in a transfer movement of the sheet metal parts 3 in the passage direction of the press, and then back in a no-load movement. When the suction devices 19 or magnets are controlled correspondingly, the lifting/lowering drive 25 causes the lifting of the sheet metal parts 3 out of a depiling or orientation (alignment) station or out of the tool and a depositing into the tool or onto a piling station, an insertion nest or an intermediate depositing device.

Figure 5:
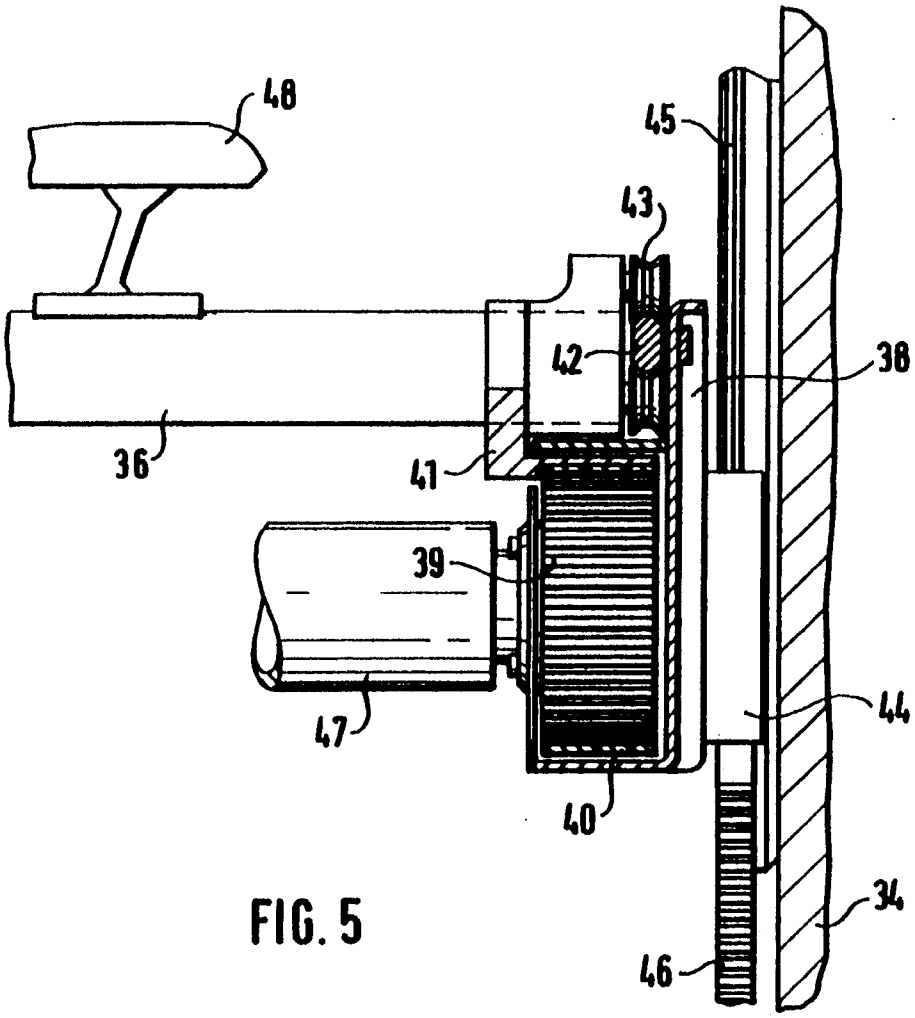
FIG. 5 is a sectional representation corresponding to section V—V in FIG. 4.
Figure 4:
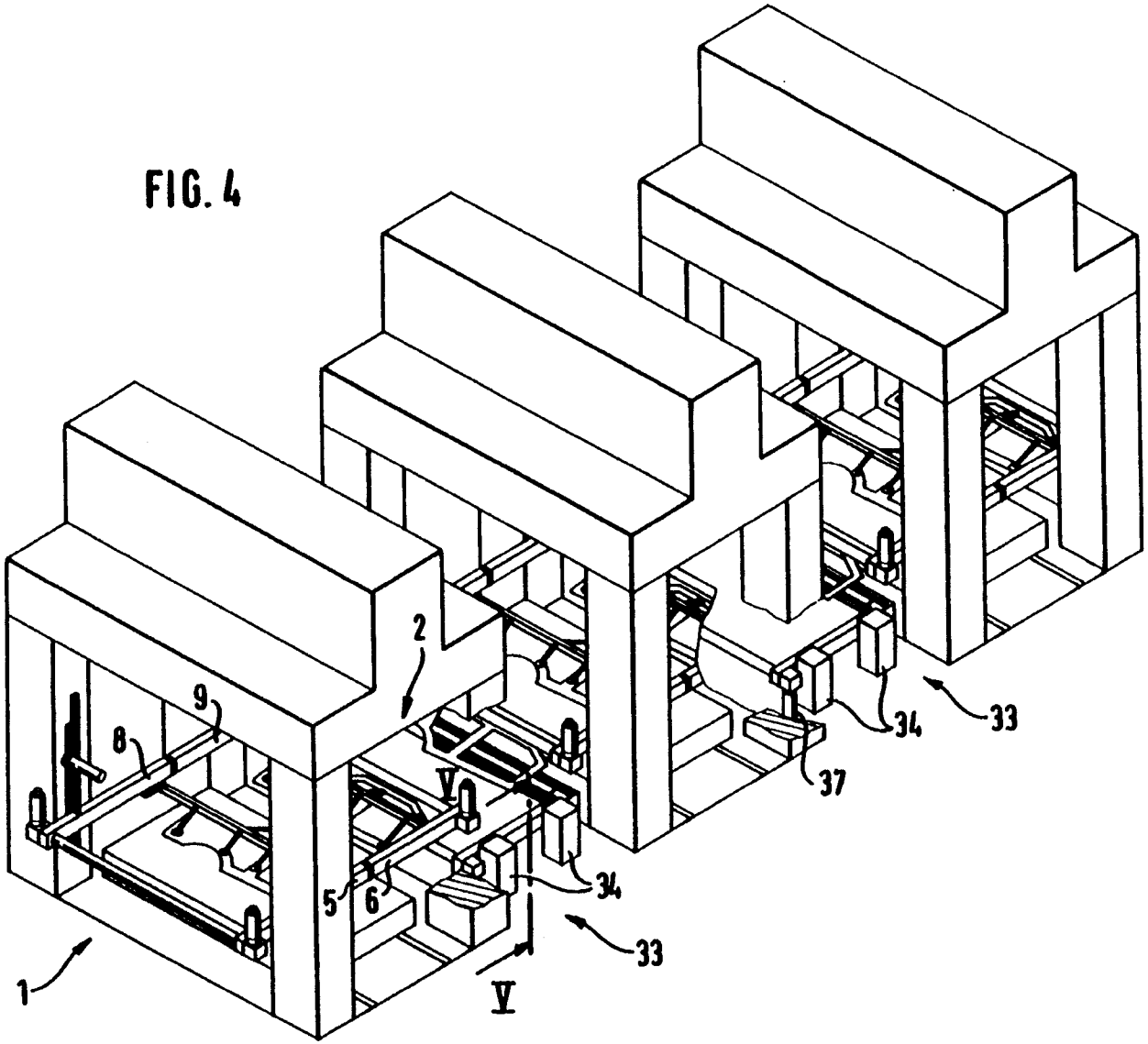
FIG. 4 is a view of a press line set up from individual presses of the type according to FIG. 1.
Figure 6:
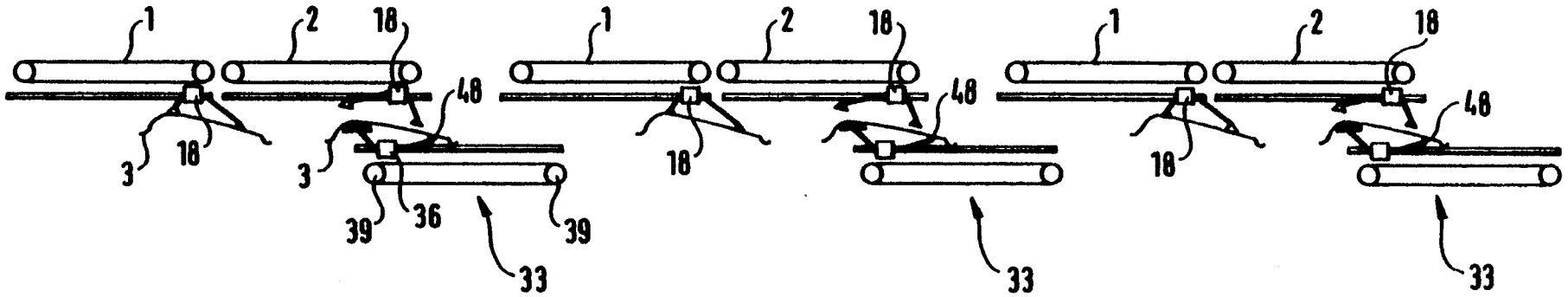
FIG. 6 is a view of transfer devices according to the invention which are used in presses or in a press line.

Corresponding to FIGS. 4, 5 and 6, the above-described transfer device, insertion or removal feeder 1, 2 also operates with an intermediate depositing device 33 between machining stages or individual presses of a press line. The individual presses have transfer devices and/or insertion feeders 1 and removal feeders 2 of the above-described type with the guide strips 5, 6, 8, 9.

In this case, the intermediate depositing devices are devices 33 on the ground comprising one or two columns 34 for receiving the guiding and driving devices which move traverses 36. Reference number 37 indicates a servomotor which is visible in FIG. 4 and which is fixed to the press for a horizontal movement of one or several traverses 36 (FIG. 5). The devices which may not be clearly visible are constructed and have the effect described previously in FIGS. 1 to 3. FIG. 5 illustrates one of two guide strips 38 in which two deflecting rollers are rotatably disposed of which only the travelling deflecting roller 39 is visible. The second deflecting roller is driven by the motor. A toothed belt 40 is placed around the deflecting rollers, and the traverse 36 is fastened to the toothed belt 40 by driving devices 41. The traverse 36 is disposed in a horizontally displaceable manner via rollers 43 in a guide rail 42. The guide strip 38 is rigidly connected with a guide carriage 44 which is guided in a liftable and lowerable manner in a vertical guide 45. A toothed rack 46 is rigidly connected with the guide carriage 44. The toothed rack 46 is vertically oriented and, via a lifting/lowering drive, as illustrated in FIG. 2 and indicated there by means of reference number 25, can be acted upon by a gearwheel similar to gearwheel 24 in FIG. 2. The gearwheels are connected with one another by a torsion bar 47. In this case, the traverse 36 carries templates 48 (FIG. 5) on which sheet metal parts 3 may be placed by means of the transfer device or the removal feeder 2 and can be transported corresponding to the drives, servomotors 37 and 25, transmissions and deflecting devices into the removal station for the following machining stage or the final removal station. The final removal may again take place by means of a transfer device, as illustrated in FIG. 6.

FIG. 6 shows transfer devices 1, 2 of the type according to FIG. 1 with the suction bars 18 or traverses as well as intermediate depositing devices 33 with templates 48 which are directed vertically upward. It is understood that the invention is not limited to the mentioned devices and arrangements. Toothed belts for the horizontal movement may be replaced by toothed racks; toothed racks of the vertical movement may be replaced by toothed belts. The guide strips as well as the driving devices may also be arranged on press stands or on a press mounting instead of on a frame device or on a frame. The templates 48 need to be constructed corresponding to the shape of the sheet metal part 3 to be received. If the transfer device, such as the device 33 on the ground, is used as the insertion device of a formed metal sheet in front of the first press of the press line, it will have correspondingly flatly constructed templates 48.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A forming facility comprising:

at least one press slide for the forming of sheet metal parts in machining stages and is movable up and down while interacting with tools;

a first transfer device with holding devices which hold and transfer the sheet metal parts, the first transfer device having first driving devices for the lifting and lowering of the holding devices and second driving devices for moving the holding devices in a passage direction through one of the machining stages; and a second transfer device with holding devices for a sheet metal part, the holding devices of the second transfer device being liftable and lowerable and movable horizontally in and against the passage direction, the second transfer device being connected at least one of in front of and behind the first transfer device, the second transfer device at least one of inserting the sheet metal parts and removing the sheet metal parts in and out of one of the machining stages for conveyance of the sheet metal parts in the passage direction;

wherein the second transfer device includes: guide strips in which the holding devices are disposed in a displaceable manner, the guide strips being arranged in parallel and at a distance from one another and extending along the passage direction and in front of and behind a workpiece passage; vertical guides on a side of the press, the guide strips being disposed in the vertical guides, each of the guide strips, for the receiving and bearing of at least one transport device extending in the passage direction, having structural members permitting movements of the transport device; a first adjusting device coupled to the guide strips to lift and lower the guide strips in the vertical guides; and a second adjusting device coupled to each of the transport devices to move the transport devices along the passage direction, the holding devices being fastened to the transport devices.

2. A forming facility according to claim 1, wherein the holding devices of the second transfer device include at least one template carrier aligned transversely with respect to the passage direction and horizontally, templates on the template carriers, each of the template carriers displaceably disposed on one guide rail per guide strip and fastened at an end face of the template carrier on the transport devices movable in the opposite guide strips.

3. A forming facility according to claim 2, wherein the driving devices are connected with one another via one torsion bar respectively.

4. A forming facility according to claim 1, wherein each of the second transfer devices has one transport device respectively for each guide strip, which transport device is guided around on the deflecting rollers, of which one deflecting roller is driven by an adjusting device.

5. A forming facility according to claim 1, wherein each of the guide strips has a guide rail for the horizontal displaceability of the holding device with each of the guide strips being disposed in one of the vertical guides so as to be liftable and lowerable via an adjusting device, and the lifting-lowering movement is performed by a meshing transmission with a toothed rack fastened on the guide strip, via the adjusting devices.

6. A forming facility according to claim 1, wherein the second transfer device is arranged in a device on the ground arranged at least one of in front of the first machining stage or press, between two machining stages or presses, and behind the last machining stage or press.

7. A forming facility comprising:

a plurality of presses combined in a press line, with at least one slide for each press which can be moved up and down for the forming of sheet metal parts while interacting with tools;

transfer devices with holding devices holding and transferring the sheet metal parts, comprising driving devices for the lifting and lowering of the holding devices and driving devices for moving the holding devices horizontally in a passage direction;

wherein each of the presses has a first one of the transfer devices respectively which removes the sheet metal part from an insertion stage or a machining stage and conveys the sheet metal part in the passage direction, and a second one of the transfer devices is connected between the first transfer device of one press and the first transfer device of the press which follows in the press line;

wherein the second transfer device includes: guide strips in which the holding devices are disposed in a displaceable manner, the guide strips being arranged in parallel and at a distance from one another and extending along the passage direction and in front of and behind a workpiece passage; vertical guides on a side of the press, the guide strips being disposed in the vertical guides, each of the guide strips, for the receiving and bearing of at least one transport device extending in the passage direction, having structural members permitting movements of the transport device; a first adjusting device coupled to the guide strips to lift and lower the guide strips in the vertical guides; and a second adjusting device coupled to each of the transport devices to move the transport devices along the passage direction, the holding devices being fastened to the transport devices.

8. A forming facility according to claim 7, wherein the holding devices of the second transfer device include at least one template carrier aligned transversely with respect to the passage direction and horizontally, templates on the template carriers, each of the template carriers displaceably disposed on one guide rail per guide strip and fastened at an end face of the template carrier on the transport devices movable in the opposite guide strips.

9. A forming facility according to claim 8, wherein the driving devices are connected with one another via one torsion bar respectively.

10. A forming facility according to claim 7, further comprising deflecting rollers, wherein each of the second transfer devices has one transport device respectively for each guide strip, which transport device is guided around on the deflecting rollers, of which one deflecting roller is driven by an adjusting device.

11. A forming facility according to claim 7, wherein each of the guide strips has a guide rail for the horizontal displaceability of the holding device, with each of the guide strips being disposed in one of the vertical guides so as to be liftable and lowerable via an adjusting device, and the lifting-lowering movement is performed by a meshing transmission with a toothed rack fastened on the guide strip, via the adjusting devices.

12. A forming facility according to claim 7, wherein the second transfer device is arranged in a device on the ground arranged at least one of in front of the first machining stage or press, between two machining stages or presses, and behind the last machining stage or press.

13. A forming facility comprising:

a plurality of presses combined in a press line, with at least one side for each press which can be moved up and down for the forming of sheet metal parts while interacting with tools;

transfer devices with holding devices holding and transferring the sheet metal parts, comprising driving devices for the lifting and lowering of the holding devices and driving devices for moving the holding devices horizontally in a passage direction;

wherein each of the presses has a first one of the transfer devices respectively which removes the sheet metal part from an insertion stage or a machining stage and conveys the sheet metal part in the passage direction, and a second one of the transfer devices is connected between the first transfer device of one press and the first transfer device of the press which follows in the press line wherein each of the guide strips has a guide rail for the horizontal displaceability of the holding device, with each of the guide strips being disposed in one of the vertical guides so as to be liftable and lowerable via an adjusting device, and a lifting-lowering movement is performed by a meshing transmission with a toothed rack fastened on the guide strip, via the adjusting devices.

14. A forming facility comprising:

at least one press slide for the forming of sheet metal parts in machining stages and is movable up and down while interacting with tools;

a first transfer device with holding devices which hold and transfer the sheet metal parts, the first transfer device having first driving devices for the lifting and lowering of the holding devices and second driving devices for moving the holding devices in a passage direction through one of the machining stages; and a second transfer device with holding devices for a sheen metal part, the holding devices of the second transfer device being liftable and lowerable and movable horizontally in and against the passage direction, the second transfer device being connected at least one of in front of and behind the first transfer device, the second transfer device at least one of inserting the sheet metal parts and removing the sheet metal parts in and out of one of the machining stages for conveyance of the sheet metal parts in the passage direction;

wherein each of the guide strips has a guide rail for the horizontal displaceability of the holding device, with each of the guide strips being disposed in one of the vertical guides so as to be liftable and lowerable via an adjusting device, and the lifting-lowering movement is performed by a meshing transmission with a toothed rack fastened on the guide strip, via the adjusting devices.

* * * * *